United States Patent [19]

Pierre

[11] 4,134,152

[45] Jan. 16, 1979

[54] APRON AND METHOD FOR PRECIOUS METAL RECOVERY

[75] Inventor: Gerald R. Pierre, 16623 Kettleriver Blvd., Forest Lake, Minn. 55025

[73] Assignee: Gerald Roy Pierre, Forest Lake, Minn.

[21] Appl. No.: 798,813

[22] Filed: May 20, 1977

[51] Int. Cl.[2] ..... A41B 13/10

[52] U.S. Cl. ..... 2/51

[58] Field of Search ..... 2/49 R, 51 R

[56] References Cited

U.S. PATENT DOCUMENTS

| | | | |
|---|---|---|---|
| 3,146,464 | 9/1964 | Burnett | 2/49 R |
| 3,916,447 | 11/1975 | Thompson | 2/49 R X |

*Primary Examiner*—Werner H. Schroeder
*Assistant Examiner*—Doris L. Troutman
*Attorney, Agent, or Firm*—Stuart R. Hemphill

[57] ABSTRACT

An apron for use by persons working with precious metals, particles of which are dispersed as work is performed, comprises a sheet of combustible material having particle-trapping capabilities and means for fastening the sheet of material to the upper body of a person whereby particles dispersed come into contact with the sheet of material and are trapped. A method for recovery of precious metal particles produced by persons working with precious metal alloys comprises the steps of trapping the precious metal particles on the sheet of combustible material worn by the person working with the precious metal alloys, burning the sheet of combustible material containing the entrapped metal particles to produce an incinerated mass and refining the incinerated mass to separate and purify the constituents of the precious metal alloys.

4 Claims, 2 Drawing Figures

APRON AND METHOD FOR PRECIOUS METAL RECOVERY

BACKGROUND OF THE INVENTION

1. Field of the Invention

The present invention relates to an apron used for recovering particles of precious materials produced during manufacture of dental or jewelry articles, etc., and the method of using this apron. More particularly, this invention relates to an apron which traps precious metal particles and which, when it has accumulated enough particles, is used, in its entirety, as raw material for a metal recovery process.

2. Description of the Prior Art

It is known that in the manufacture of dental and jewelry articles, and other articles made of precious metals or other materials, signficant amounts of particles are removed by craftsman as a result of grinding or other working processes. Particularly when high-speed grinding tools are used, the precious metal particles which are removed from the workpiece are dispersed over a rather wide area and many are deposited upon the clothing or skin of the craftsman working with the article. Because, in the case of precious metal articles, typical alloys used contain up to seventy or eighty percent gold or silver as well as significant amounts of platinum and palladium, recovery of these particles can have considerable economic importance.

A number of arrangements and methods are known in the prior art which are used to collect precious metal particles produced during metal working operations. Attachments to grinding machinery which use enclosures or suction, or a combination of the two, are knwon; e.g., Luden, U.S. Pat. No. 1,393,892. Also known are cups or receptacles into which a precious metal workpiece and tool are inserted and which form a particle-entrapping enclosure around the workpiece, e.g., Voigt, U.S. Pat. No. 1,742,331. In one such device, the particle-entrapping enclosure also includes a small attached receptacle in which trapped particles are accumulated; e.g., Ousley, U.S. Pat. No. 1,255,040. An additional arrangement, also known in the prior art, is a combination grindings catcher and shield, comprising a formed metal sheet worn by a craftsman working over an open drawer and shaped such that it channels metal particles into the drawer; e.g., Globe, U.S. Pat. No. 2,637,852.

Each of the prior art arrangements and methods for collecting precious metal articles suffers from certain limitations or disadvantages. Enclosure and suction devices fitted to grinding wheels or tables are of limited value because the need for access to the grinding wheel limits the amount of suction which can be generated in the critical area and results in an opening through which particles can escape. Moreover, precious metal particles, being generally of greater weight (and, therefore having greater momentum) than other grindings, tend to escape a suction system. Particle collection cups are unsatisfactory, because they unnecessarily confine the working area available for the craftsman's hands and tools and because they must be carefully cleaned to remove accumulated particles. A metal shield worn by a craftsman is also unsatisfactory, because it is uncomfortable to wear and must be used in conjunction with a drawer at its lower end to collect channeled particles. Accordingly, none of the prior art devices or methods are particularly efficient for particle collection; nor are they easy for a craftsman to use or particularly adapted to a full recovery process.

SUMMARY OF THE INVENTION

The present invention is a precious metals recovery apron which is inexpensive, comfortable to wear, effective for collecting significant amounts of precious metal particles and which may be used as raw material in a metals recovery process. The invention also includes the method of using the apron. Both apron and method can be used with or without additional suction particle collection arrangements. According to the present invention, an apron for use by persons working with precious materials, particles of which are dispersed onto said person's clothing as work is performed, comprises a sheet of material having particle trapping capabilities and means for fastening said sheet of material to the front abdominal area of said person in such a way that particles come into contact with said sheet of material. The sheet of material used is preferably a combustible material and is formed to have a pocket at its lower edge. The method of the present invention, used for recovery of precious metal particles produced by persons working with precious metal alloys, comprises trapping precious metal particles on a sheet of combustible material worn by the person working with the precious metal; burning the sheet of combustible material with the precious metal particles entrapped to produce an incinerated mass; and refining the incinerated mass to separate and purify the constituents of the precious metal alloys.

It is an object of the present invention to provide an apron which traps precious metal particles for later recovery.

It is another object of the present invention to provide an apron which protects a craftsman's clothing while trapping precious metal particles.

It is a further object of the present invention to provide a combustible apron on which precious metal particles can be collected for later use in a recovery process which includes the step of burning the apron.

It is a still further object of the present invention to provide a method for recovering precious metal particles by trapping them on a combustible substrate which is used as raw material for a recovery process.

These and other objects of the invention will become apparent from a study of the following description of the preferred embodiment and method, including the accompanying FIGS.

DESCRIPTION OF THE PREFERRED EMBODIMENT

Figure 1:
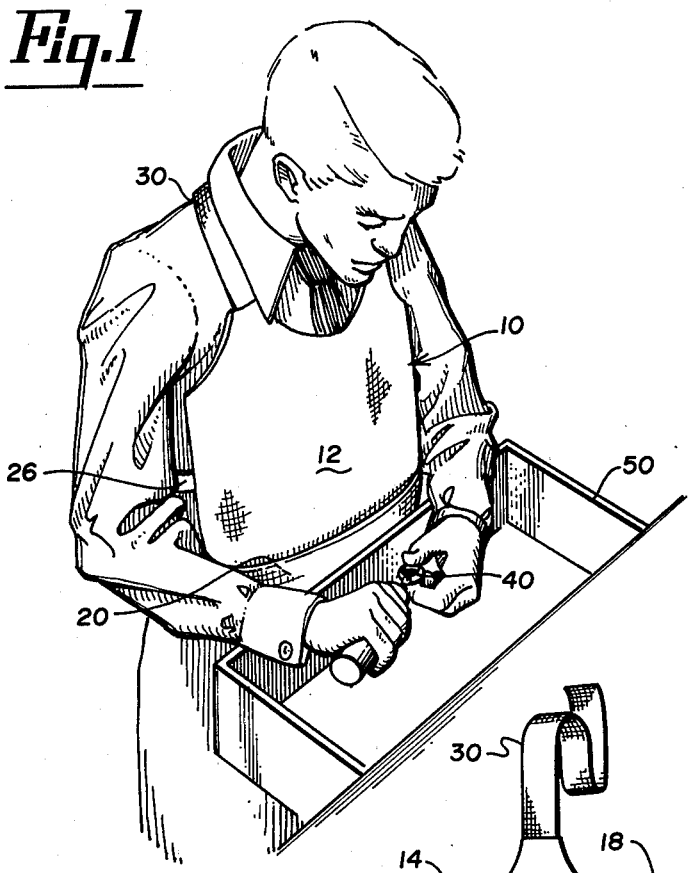
FIG. 1 is a pictorial view of the present invention showing its use by a craftsman working with a grinding wheel.

As shown in FIG. 1, the apron 10 of the present invention is formed from a substantially rectangular sheet of material 12 which is adapted to be worn on and to cover the front of the upper body. In the preferred embodiment, the sheet of material 12 from which the apron 10 is made is a non-woven material selected for its particle-trapping characteristics. Accordingly, its texture will be such that the spaces between fibers in the material are of various sizes, corresponding generally to the range of particle sizes produced in working with particular types of precious metal alloys and particular grades of grinding wheels. While there is a wide variety of non-woven materials available on the market, it has been found that due to the typical size and shape of particles produced in precious metal working operations, a material such as that produced by Pellon Corporation and designated by the trademark Pellon is most suitable. This material has been found to be effective for trapping particles in the size range from approximately No. 16 to No. 400 on the Tyler Standard Sieve Series.

In addition to its particle-trapping characteristics and capabilities, the material from which the sheet 12 is made also preferably has combustion characteristics suitable for use in a metal recovery process during which the apron 10 with its entrapped particles is burned. A material such as Pellon fabric which has a relatively low ignition temperature, approximately 300 to 500 degrees Fahrenheit, and is completely combusted at about 1600 degrees Fahrenheit, has been found suitable from this viewpoint. Once the material is completely combusted, the remaining mass consists primarily only of the precious metals whose recovery is desired and carbon, which is of use in the further refining processes for recovery of the metal.

Figure 2:
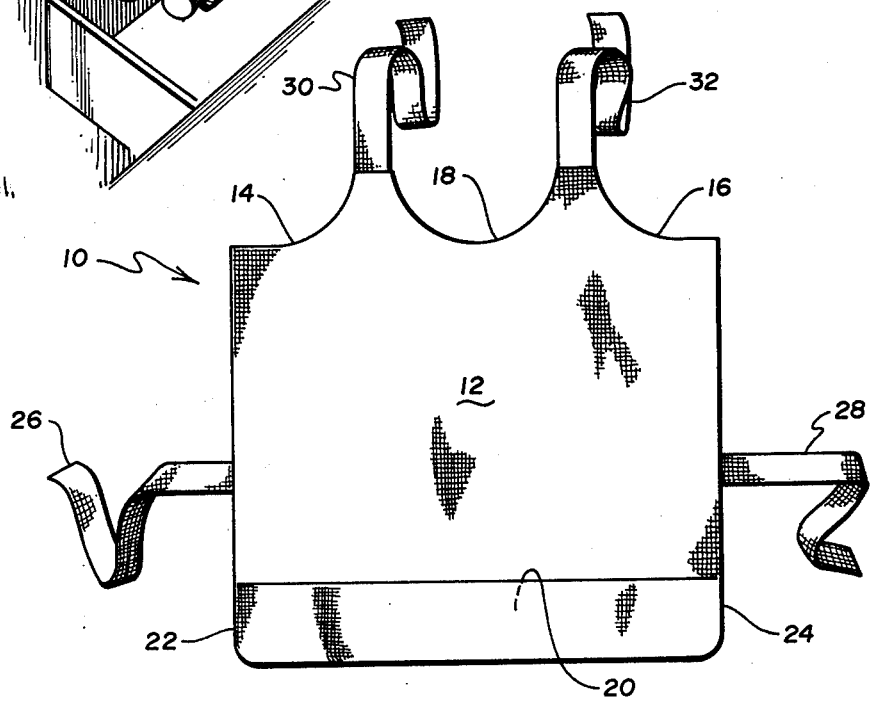
FIG. 2 is a plan view of an apron constructed in accordance with the present invention.

The cut of the apron is conventional in the apron art. For fastening the apron 10 to the body, a first pair of strings or tabs 30, 32 is attached to its upper edge (as viewed in FIG. 2), which are of suitable length and material for tying around the neck of the wearer. A second pair of tabs 26, 28 is used to fasten the apron around the waist of the wearer. One of each of this second pair of tabs 26, 28 is fastened to each of the sides of the rectangular sheet of material 12. To comfortably accommodate the neck and shoulders of the wearer, arcuate portions of the sheet of material 12 are removed on either side of and between the first pair of tabs 30, 32. The removal of these arcuate pieces forms a pair of indentations 14, 16 which accommodate the wearer's shoulders when the apron 10 is worn, and a further indentation 18 which accommodates the wearer's neck.

At the bottom of the apron 10 is a pocket 20 formed, preferably, by turning up the lower portion of the sheet of material 12 and attaching it by any suitable means, such as by sewing, to the edges 22, 24 of the lower portion of the sheet of material 12. In the preferred embodiment, the length of the apron 10 is such that the pocket 20 is approximately level with the crotch of the wearer when the wearer is standing.

Use of the apron 10 of the present invention and the method of the present invention for recovery of precious metal particles can be described as follows. As shown in FIG. 1, the apron 10 is worn by a craftsman who works with precious metals, typically using a grinding wheel 40 which is located at approximately stomach or chest height and positioned over an open drawer 50. When in place, the apron 10 covers the chest and abdomen of the wearer from the neck down past the waist. The tabs 26, 28, 30, 32 are tied around the neck and waist of the wearer to hold the apron 10 in place.

The apron 10 is worn at all times when the craftsman is performing grinding or other metal working operations in the course of which small particles of precious metal are removed from the workpiece and dispersed. In a typical dental laboratory, for example, grinding of precious metal articles, using grinding wheels of various degrees of coarseness, is a common operation. With such wheels, the workpiece is typically aligned with the eyes of the craftsman (hence, directed toward his longitudinal axis) and held near the lower edge of the grinding wheel, which rotates in such a way that particles removed during grinding are usually thrown toward the chest area of the craftsman. Accordingly, when the present invention is used, many such particles would come into contact with the apron 10. These particles are either trapped by the fibers of the sheet of material 12 or are deflected and tend to fall into the pocket 20 below. In this way significant amounts of precious metal particles can be accumulated on the apron 10 or in its pocket 20. Should movements of the wearer dislodge particles which are loosely trapped in the sheet of material 12, these will also tend to fall into the pocket 20. At the end of the day, or whatever use period is prescribed, the apron 10 is simply removed, rolled or folded with its particle-trapping surface inward, and placed in a substantially air-tight container. In laboratories or other work places where metal scraps or sweepings are accumulated for recovery purposes the apron 10 may simply be added to these accumulations. When a substantial number of aprons 10 and/or other scrap and sweepings has been accumulated, these may be shipped to a metal recovery plant where the trapped metals can be recovered in a refining process. The refining process used to recover the precious metal particles begins with a burning step which produces an incinerated mass. This mass is then used as a raw material for whatever later conventional refining steps are necessary to separate out and purify the particular constituents of the precious metal alloys which are present in the mass. The presence of the combustible material which is used to trap metal particles does not interfere with any of these steps. In the course of the burning step this material is reduced to a residue which is primarily carbon. This carbon residue actually helps to draw out impurities from the precious metals and is easily separated in later refining steps.

The above description of the preferred embodiment and method is quite specific. Those skilled in the art will perceive modifications which can be made in the preferred embodiment and method as described above without departing from the spirit of the invention. For example, although the invention has been described primarily with reference to recovery of precious metals, it is clear that it is equally applicable to the recovery of particles of any precious material which can be trapped in such an apron. Accordingly, it is intended by the appended claims to cover all such embodiments and operations as fall with the true spirit and scope of the invention. What is claimed as new and desired to be secured by Letters Patent of the United States is as follows.

I claim:

1. An apron for use by persons working with precious materials, particles of which are dispersed as work is performed, comprising:

a sheet of combustible material composed of fibers arranged such that the spaces between fibers trap solid particles in the size range from No. 16 to No. 400 on the Tyler Standard Sieve Series thrown against said material during the working of said precious materials, and the post-combustion residue of said material, including trapped particles, being suitable for use in a conventional refining process for recovering the precious material; and means for fastening said sheet of material to the upper body of said person whereby particles dispersed come into contact with said sheet of material and are trapped.

2. The apron as recited in claim 1 further comprising a pocket formed along one edge of the sheet of material.

3. The apron as recited in claim 2 wherein the sheet of material comprises a non-woven material.

4. The apron as recited in claim 1 wherein said means for fastening comprises first and second pairs of tabs for tying at the neck and waist, respectively, whereby said sheet of combustible material covers substantially all of the upper body of said person.

* * * * *